United States Patent [19]

Camara

[11] Patent Number: 4,969,291

[45] Date of Patent: Nov. 13, 1990

[54] WINDOW STRUCTURE

[76] Inventor: Octavio M. Camara, 7 Redan St., London, Ontario, Canada, N5Z 1S7

[21] Appl. No.: 232,295

[22] Filed: Aug. 15, 1988

[30] Foreign Application Priority Data

Aug. 14, 1987 [CA] Canada ..... 544544

[51] Int. Cl.[5] ..... E06B 7/28

[52] U.S. Cl. ..... 49/71; 160/97

[58] Field of Search ..... 49/71; 160/40, 352, 160/92, 97, 114, 371, DIG. 7

[56] References Cited

U.S. PATENT DOCUMENTS

| | | | |
|---|---|---|---|
| 2,093,314 | 9/1937 | MacDonald . | |
| 2,222,753 | 11/1940 | Persson . | |
| 2,294,966 | 9/1942 | Dreyfus | 160/DIG. 7 X |
| 2,494,844 | 1/1950 | Tondora | 160/97 |
| 2,572,363 | 10/1951 | Mayer et al. | 49/71 X |
| 2,925,769 | 2/1960 | Kubatzky | 49/71 X |
| 3,978,614 | 9/1976 | Goldhaber | 49/55 |
| 4,395,939 | 8/1983 | Hough et al. | 160/97 X |

FOREIGN PATENT DOCUMENTS

| | | | |
|---|---|---|---|
| 56148 | 5/1897 | Canada . | |
| 153185 | 1/1914 | Canada . | |
| 159039 | 11/1914 | Canada . | |
| 377095 | 10/1938 | Canada . | |
| 49712 | 1/1935 | Denmark | 49/71 |

*Primary Examiner*—Philip C. Kannan

*Attorney, Agent, or Firm*—Kolisch, Hartwell & Dickinson

[57] ABSTRACT

There is disclosed a window unit, comprising a frame, a sash mounted in the frame for movement between a closed position adjacent the frame to an open position in which a space is defined between the sash and the frame, a recess in the frame adjacent the sash, and screen means attached to the sash and dimensioned to fill the space when the sash is in the open position.

11 Claims, 3 Drawing Sheets

WINDOW STRUCTURE

BACKGROUND AND SUMMARY OF THE INVENTION

This invention relates to window structures, and in particular to window structures having built-in fly screens.

It is now common in building construction, especially housing construction, to use prefabricated windows that are secured in place in rough framing, usually prior to application of sheathing on the exterior of the building, and of gypsum board covering on the inside of the building. For convenience, the units are supplied with all necessary hardware, including locks, hinges and fly screens, and often mechanical means for opening and closing the window, such as a crank and linkage.

In warm climates, the fly screen associated with such units is necessary to prevent the entry of undesired insects such as mosquitoes. Indeed, in some climates, the absence of a fly screen would make comfortable occupancy of the building almost impossible.

Hitherto, most fly screens have been sized to fit over the window frame, covering it entirely, thus to some extent interfering with the view through the window.

Some attempts have been made to solve the above problem, and such an attempt is taught in U.S. Pat. No. 2,222,753 granted to E.S. Persson on Nov. 26, 1940. Persson teaches an "add on" unit dimensioned to fit in the opening created when a hinged window is swung open. The Persson unit, however, while providing for a clear or free view through the window glass, is difficult to install and has to be stored separately when the window is closed.

Likewise, MacDonald in his Canadian Patent No. 377,095 of Oct. 11, 1938 teaches a screening unit for attachment to a window that is swingable from the frame to an angular position; however the screens of MacDonald are stored outside the window when the latter is closed and thus are conspicuously visible and unattractive in appearance.

It is the purpose of the present invention to provide a window having a sash and frame equipped with a fly screen that does not obstruct the view through the window when the latter is open, and is stored out of sight when the window is closed. To this end, the invention provides a frame with a sash movably mounted thereon for movement between a closed position and an open position in which the sash is out of the plane of the frame, and screen means secured to the sash for blocking the opening against entry of insects when the window is open. The screen is relatively rigid, and when the window is closed is stored in a suitably dimensioned recess or recesses in or outside the frame. It is preferred that the recesses be within the frame, defined by separate frame portions. The sash is also preferably hinged at its top to the frame so that, viewed from the side, when the sash is opened a triangular opening is defined at each side and a rectangular opening is defined at the bottom. The screen material, which may be formed from perforated Lexan (TM) is dimensioned to fill the triangular openings and the rectangular opening, is an integral unit, and when the sash is closed retracts into the frame as described broadly above.

The unit described herein is attractive and relatively simple to build. With suitable modification it can be used as a skylight. The preferred use of a Lexan screen is advantageous, compared with the use of the normal mesh screen, because of its strength and rigidity and because it is not exposed when the window is closed. Other advantages will be apparent to those skilled in the art as the description proceeds.

BRIEF DESCRIPTION OF THE DRAWINGS

In the accompanying drawings, which illustrate an embodiment of the invention.

DETAILED DESCRIPTION OF THE PREFERRED EMBODIMENT

Figure 1:
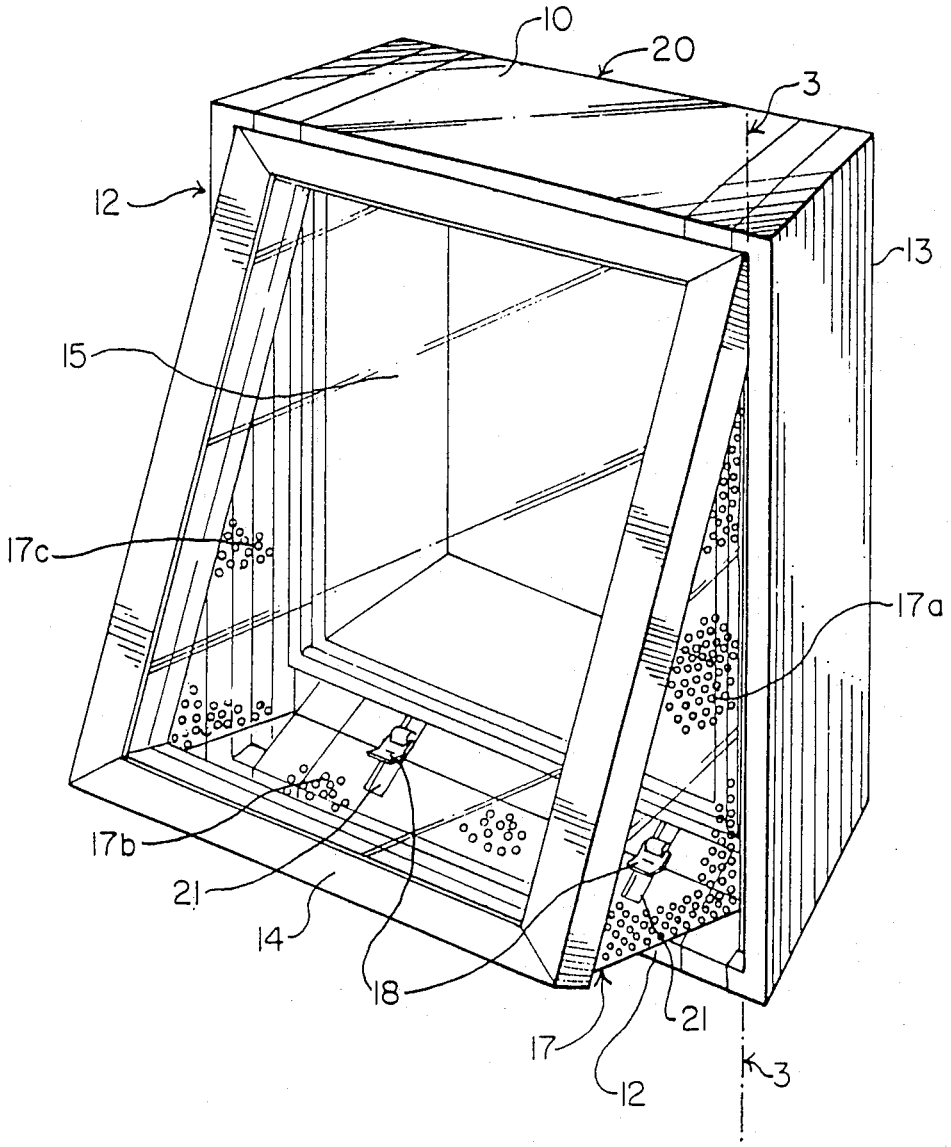
FIG. 1 is an illustration of the assembled unit, with the sash open.
Figure 2:
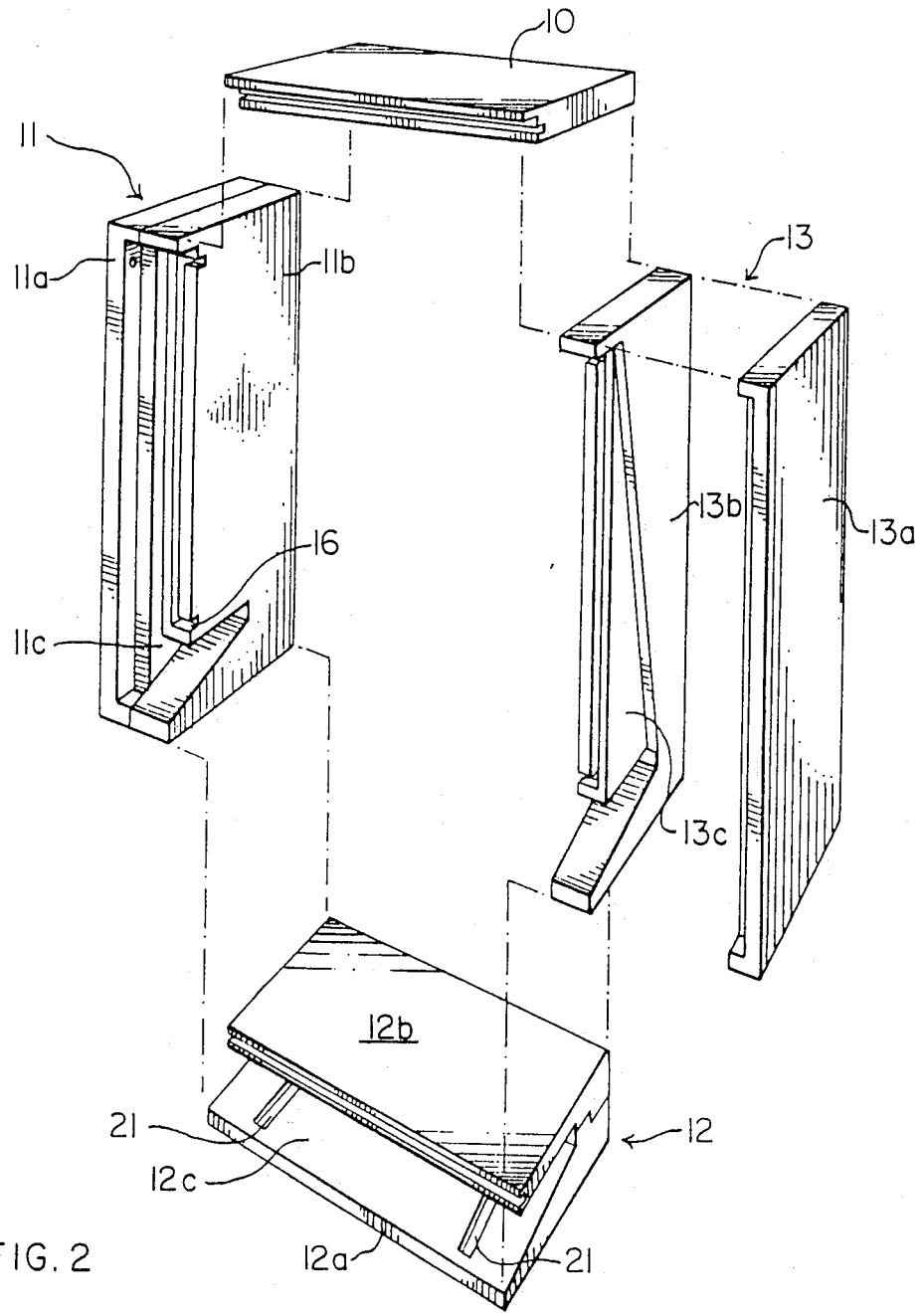
FIG. 2 is an exploded view of the window frame of the unit of FIG. 1.

As can be seen from FIGS. 1 and 2, the window frame 20 comprises an upper element 10, left and right hand side elements 11 and 13, and a lower element 12. While the upper element 10 is formed from a single section of suitable wood, the side and lower elements 11, 12 and 13 are formed in two parts.

Figure 3:
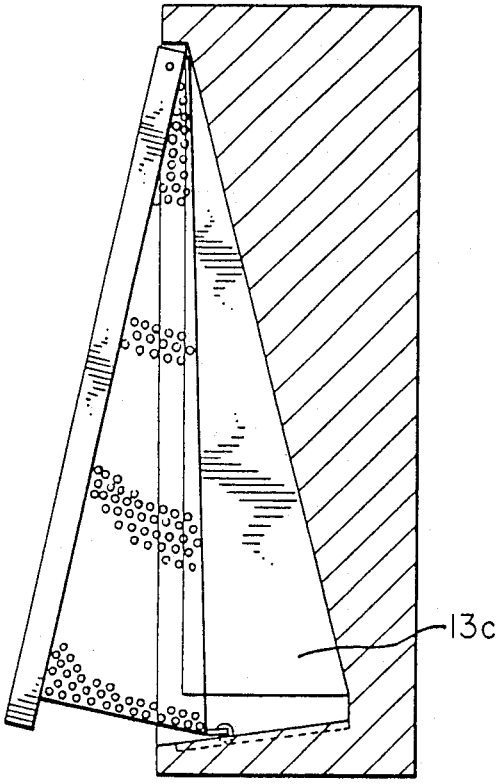
FIG. 3 is a section taken on the line 3—3 in FIG. 1, illustrating the sash open with the screen blocking the opening created by the opening of the sash.

For convenience, only one of the side elements, 13, will be described in detail since it is identical, although a mirror image, to the element 11. The side element 13 comprises an outer portion **13*a* and an inner portion 13*b*, with a recess 13*c* of generally triangular configuration cut into the portion 13*b*. Thus, when the elements 13*a* and 13*b* are joined, the recess 13*c* defines a triangular space clearly visible in FIG. 3 to receive one side of the screen element 17, as will be described below. In like manner, the lower element 12 is divided into two portions 12*a* and 12*b*, which when glued together define an opening 12*c* shaped and dimensioned to receive the lower portion 17*b* of the screen 17. Of course, as shown the recess 12*c* is extended into portions 11*b* and 13*b*. All of the above described wooden elements are preferably glued together, and may also be secured by other fastening means (not shown) for strength as is known in the art. It will be noted that running around the front of the inner portions 11*b* and 13*b* and 12*b*, and the element 10, there is provided a groove 16 for receiving a suitable weather seal of a type known in the art, so located as to abut the sash 14** when it is closed.

As will be apparent from FIG. 1, the assembled frame 20, by virtue of the construction of the particular elements described above, defines a recess, facing forwardly, the recesses in the side elements being triangular and the recess **12*c* in the lower portion 12*b*** being rectangular.

The sash 14, which is conventional and need not be described in detail, is hinged in the preferred embodiment in any suitable manner to the upper element 10. Automatic opening and closing means may be provided, but do not form part of the invention and therefore are not described here in detail.

The Lexan screen 17 comprises triangular side portions **17*a* and 17*c* and rectangular base 17*b*. It is secured to the insides and bottom of the sash by glue and/or suitable mechanical fasteners. Rollers 18 of a type known in the art are secured to the lower portion of the screen 17*b*, and these rollers ride in tracks 21 in the lower portion 12*a* of the base 12**. The rollers guide the screen as it moves between the open and closed positions.

The screen 17 is dimensioned so that the sides 17*a* and 17*c* closely engage the outer portions 11*a* and 13*a* of the frame 11 and 13. The lower portion 17*b* of the screen, as a consequence of careful shaping of the element 12*a* of the lower frame element 12, remains closely adjacent the inside of lower portion 12*a* of element 12.

The profiles of the elements 10, 11, 12 and 13 may vary, as will be clear to persons skilled in the art, so long as the objective of accommodating the sash and screen are achieved.

There has thus been described a prefabricated window unit that can easily and cheaply be made, that, when opened, provides a screened opening without the screening material blocking the view through the glass, that lends itself to mass production, at low cost, and takes advantage of modern materials to improve resistance to damage and ware.

It is claimed and desired to secure by Letters Patent:

1. A glazed window unit, comprising:

a frame;

a glazed window sash mounted in the frame for movement between a closed position adjacent the frame to an open end position in which a space is defined between the sash and the frame a recess in the frame adjacent the sash, and screen means permanently secured to the sash and dimensioned to fill the space when the sash is in the open position, and to nest substantially invisibly within the recess when the sash is in the closed position.

2. The unit defined in claim 1 wherein the sash and frame are rectangular and the sash, also rectangular, is hinged to the frame, the recess extends around three sides of the frame, other than the side to which the sash is hinged, and the recess is normal to the plane of the sash, the screen being attached to the sash on three sides thereof matching the recessed sides of the frame, and being so dimensioned that it is a sliding fit in the recess.

3. The unit defined in claim 2 wherein the said three sides of the frame are each formed from two sections of wood profiled so that, when assembled, the recess is defined between the sections.

4. The unit defined in claim 3 wherein the screen is provided with rollers disposed to ride in tracks in the recess to guide the screen during movement between the closed and open positions.

5. The unit defined in claim 4 wherein the screen is formed from a suitable plastic material having perforations small enough to exclude insects but large enough to permit free passage of air.

6. The unit defined in claim 1 or 2 or 3 wherein the screen is formed from a suitable plastic material having perforations small enough to exclude insects but large enough to permit free passage of air.

7. A glazed window unit as claimed in claim 1 in which said screen means comprises a screen made from perforated Lexan.

8. A window unit, comprising:

a rectangular frame a rectangular sash hinged to the frame and mounted in the frame for movement between a closed position adjacent the frame and an open position in which a space is defined between the sash and the frame, a recess in the frame adjacent the sash window extends around three sides of the frame, other than the side to which the sash is hinged, and the recess is normal to the plane of the sash, screen means attached to the sash on three sides thereof matching the recessed sides of the frame and being so dimensioned to provide a sliding fit in the recess and to fill the space when the sash is in the open position, and to nest in the recess when the sash is in the closed position, wherein the said three sides of the frame are each formed from two sections of wood profiled so that, when assembled, the recess is defined between the sections.

9. The unit defined in claim 8 wherein the screen is formed from a suitable plastic material having perforations small enough to exclude insects but large enough to permit free passage of air.

10. The unit defined in claim 8 wherein the screen is provided with rollers disposed to ride in tracks in the recess to guide the screen during movement between the closed and open positions.

11. The unit defined in claim 10 wherein the screen is formed from a suitable plastic material having perforations small enough to exclude insects but large enough to permit free passage of air.

* * * * *